United States Patent [19]

Melzi et al.

[11] Patent Number: 4,513,883

[45] Date of Patent: Apr. 30, 1985

[54] NO-FLIP, NO-DRIP CONTAINER

[76] Inventors: Edward R. Melzi, 3310 Ivanhoe La., Garland, Tex. 75042; Arie Sharon, 1014 Wake Dr., Richardson, Tex. 75081

[21] Appl. No.: 529,509

[22] Filed: Sep. 6, 1983

[51] Int. Cl.[3] ..... B67B 7/24

[52] U.S. Cl. ..... 222/83; 206/603; 220/263; 220/271; 222/85; 222/484; 222/541; 222/510

[58] Field of Search ..... 222/81, 85, 83, 510, 222/531, 484, 541, 478; 206/603; 220/262, 263, 270, 271

[56] References Cited

U.S. PATENT DOCUMENTS

| | | | |
|---|---|---|---|
| 2,063,525 | 12/1936 | Schickel | 222/83 |
| 2,319,517 | 5/1943 | Rand | 222/484 |
| 2,349,665 | 5/1944 | Levit | 222/510 |
| 3,437,245 | 4/1969 | Hebert et al. | 222/541 |
| 4,200,198 | 4/1980 | West | 220/271 |
| 4,221,291 | 9/1980 | Hart | 222/83 |

*Primary Examiner*—H. Grant Skaggs

*Attorney, Agent, or Firm*—Glaser, Griggs & Schwartz

[57] ABSTRACT

A disposable oil can having displacable tab portions on the top and bottom lids, with a connecting rod lodged between the tabs. According to this arrangement, the oil can can be opened manually by pressing downwardly on the upper tab portion to cause the lower tab portion to open for drainage directly into the crankcase of an automobile without utilizing a pour spout. In an alternate embodiment, the upper pre-scored tab portion opens upwardly, and the lower pre-scored tab portion opens downwardly. A pivot bar is attached to the lower tab portion and is coupled to the upper tab portion so that upward movement of the upper tab causes downward rotation of the lower tab portion.

3 Claims, 8 Drawing Figures

NO-FLIP, NO-DRIP CONTAINER

BACKGROUND OF THE INVENTION

1. Field of the Invention

This invention relates to containers for storing and dispensing liquids such as motor oil and the like.

2. Description of the Prior Art

The conventional one-quart oil can is sealed by upper and lower lids which are bonded and secured to a cylindrical sidewall. According to usual practice, the upper lid is punctured by a device such as a can opener or by a curved pour spout having a punch attachment so that the oil can be drained into the engine. The curved pour spout/punch combination includes a bayonet which ruptures the lid and a clamp portion which engages the cylindrical sidewall of the can to hold the pour spout in place.

Considerable care must be taken when using either device to avoid an oil spill. For example, when using a conventional can opener punch, it is customary to form a drain opening and a vent opening to allow the oil to drain freely. Oil will usually drain through both punch openings as the can is rotated to the upside-down drain position whereby oil may spill onto the garage floor or onto the automobile engine. When using the combination pour spout/punch, the same type of leakage is likely to occur if a "breather" opening is made in the upper lid. Moreover, some oil containers have a stiff paper sidewall which is subject to buckling or crushing in response to the downward force applied as the bayonet portion of the combination pour spout/punch is used.

A funnel will be required, in some instances, to ensure that the oil will not spill as it is poured into the engine. After using the funnel and the can opener or curved pour spout, these tools must be cleaned and put away. In carrying out these tasks, it is obvious that it is very likely that oil will spill onto the engine, the floor, or onto the operator's hands or clothing.

OBJECT OF THE INVENTION

The principal object of the invention is to provide a metal container which may be opened manually for drainage in an upright position at the point of use without employment of auxilliary tools or equipment.

SUMMARY OF THE INVENTION

A disposable oil can is provided having punch-out tab portions on the top and bottom lids, with a connecting rod lodged between the tabs. According to this arrangement, the oil can can be opened manually in an upright position by pressing downwardly on the upper tab portion to cause the lower tab portion to open for drainage directly into the crankcase of an automobile without utilizing a pour spout. In an alternate embodiment, the upper pre-scored tab portion opens upwardly, and the lower pre-scored tab portion opens downwardly. A pivot bar is attached to the lower tab portion and is coupled to the upper tab portion so that upward movement of the upper tab causes downward rotation of the lower tab portion.

The novel features which characterize the invention are defined by the appended claims. The foregoing and other objects, advantages and features will hereinafter appear and for purposes of illustration of the invention, but not of limitation, exemplary embodiments of the invention are shown in the appended drawings.

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention. As used herein, the terms "inwardly" and "outwardly" indicate directions relative to the interior and exterior, respectively, of a cylindrical container.

Figure 1:
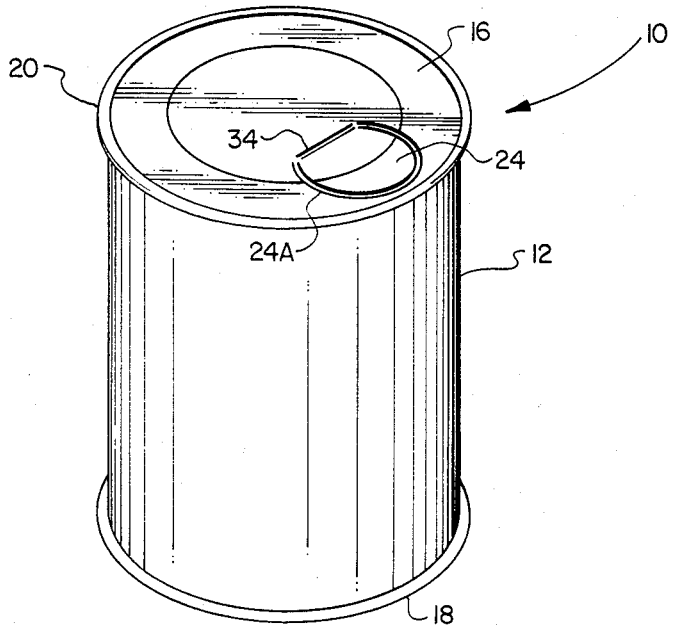
FIG. 1 is a perspective view of an oil can constructed according to the teachings of the present invention.
Figure 2:
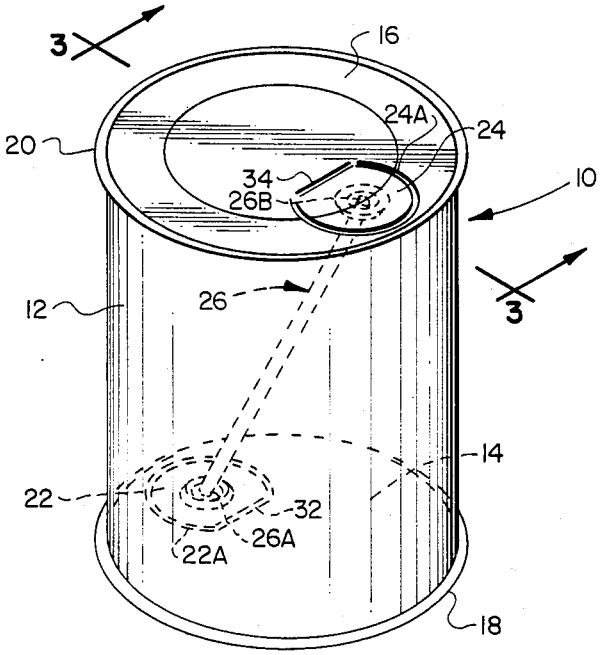
FIG. 2 is a view similar to FIG. 1 which illustrates the actuating mechanism of the invention.

Referring now to FIGS. 1 and 2, an improved, disposable oil can 10 is illustrated. The improved can assembly 10 has a cylindrical sidewall 12 which is sealed at opposite ends by a lower lid 14 and an upper lid 16. Preferably, the lower lid 14 and the upper lid 16 are constructed of a thin guage, high strength metal alloy such as work-hardened aluminum base alloy sheet material in the thickness range of 0.010 inch to 0.05 inch. The lower and upper lids 14, 16 are sealed along the lower and upper peripheral edges of the cylindrical sidewall 12 by conventional double-seaming operations, thereby forming double-sealed rims 18, 20, respectively. The cylindrical sidewall may be constructed of any durable material such as sheet metal or stiff cardboard stock.

Figure 3:
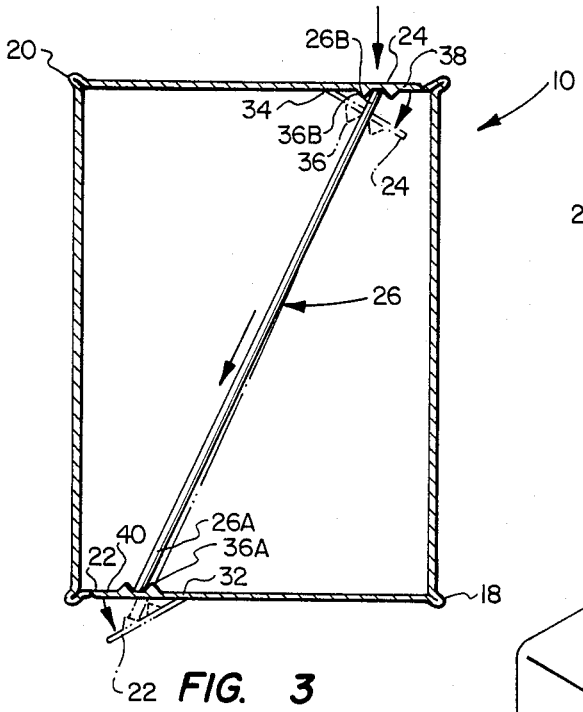
FIG. 3 is a side view, in elevation, which illustrates operation of the drainage mechanism of the invention.
Figure 4:
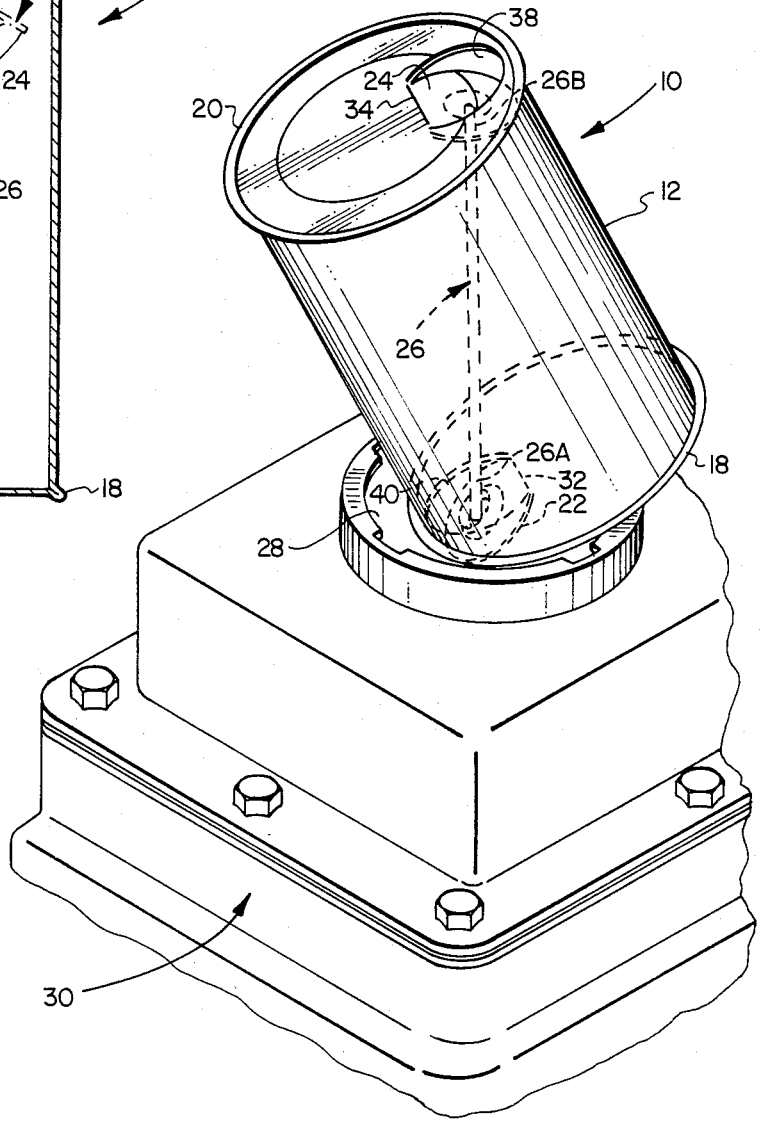
FIG. 4 is a perspective view which illustrates the preferred usage of the invention.

According to an important feature of the invention, the disposable container assembly 10 is provided with lower and upper displaceable tab portions 22, 24, respectively, which are connected together by a rigid connecting rod 26. In this arrangement, the oil can 10 can be opened manually while it is in the upright position at the point of use. A rupturing force is applied manually by pressing downwardly on the upper tab 24 to cause the lower tab portion 22 to open for drainage directly into the crankcase oil fill opening 28 of an automobile engine 30, as illustrated in FIGS. 3 and 4.

Each of the lower and upper tabs 22, 24 are C-shaped with a bridge of metal defining a hinge 32, 34 about which each tab rotates. The metal portions forming each end 32, 34 also prevent the tab portions from separating from the container assembly 10 after displacement.

The C-shaped tab portions 22, 24 are defined by grooves or score lines 22A, 24A, respectively, which are formed prior to assembly by conventional machine dies. The score lines 22A, 24A are formed on the top and bottom of each lid by dies which pinch or extrude the lid metal to form a fractionable web having a thickness of less than one half of the unscored web thickness. For example, for lower and upper lids made of a sheet of hard temper aluminum base alloy of 0.013 inch thickness, the fracturable web between the score lines would have a thickness of approximately 0.004 inches.

The connecting rod 26 is preferably made of a stiff, high strength polymer material such as Nylon. The lower end 26A is bonded in place within a detent 36A formed onto the lower tab 22. During assembly, the upper end 26B of the connecting rod is lodged within a detent structure 36B which is formed on the underside of the upper tab 24. According to this arrangement, downward rotation of the upper tab 24 is transmitted through the connecting rod 26 to the lower tab closure 24. Thus, as the upper tab 24 rotates downwardly and inwardly, the lower tab closure 22 rotates downwardly and outwardly. This performed manually by applying downwardly directed pressure onto the upper tab closure 24 until the metal in the region between the score line separates. This pressure is transmitted through the connecting rod 26 to cause the metal in the score line region 22A to fracture. A vent opening 38 is formed as the upper closure tab 24 rotates downwardly and inwardly, while a drainage opening 40 is formed as the lower tab closure 22 rotates downwardly and outwardly.

Figure 5:
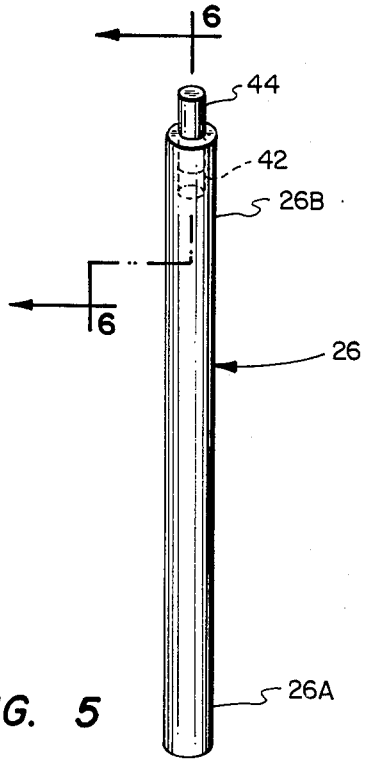
FIG. 5 is a perspective view of an alternate embodiment of the connecting rod.
Figure 6:
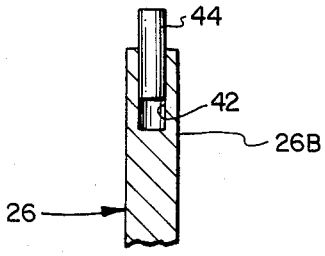
FIG. 6 is a sectional view taken along the lines VI—VI of FIG. 5.

Referring now to FIGS. 5 and 6, an alternate embodiment of the connecting rod 26 is illustrated. In this arrangement, the connecting rod is provided with an axial bore opening 42 on its upper end 26B. Received within the axial bore 42 is a plunger rod segment 44 which is disposed in frictional engagement with the sidewalls of the bore 42. According to this arrangement, the plunger rod segment 44 must be pushed all the way into the bore 42 before the opening force will be transmitted to the lower tab opening 22. The purpose of this arrangement is to prevent inadvertent opening of the container assembly during its exposure to shock forces and other loading forces occasioned by container handling and shipping. The amount of displacement required, however, is small enough so that the closure tab portions will fracture along the score lines in response to digitally applied inwardly directed forces.

Figure 7:
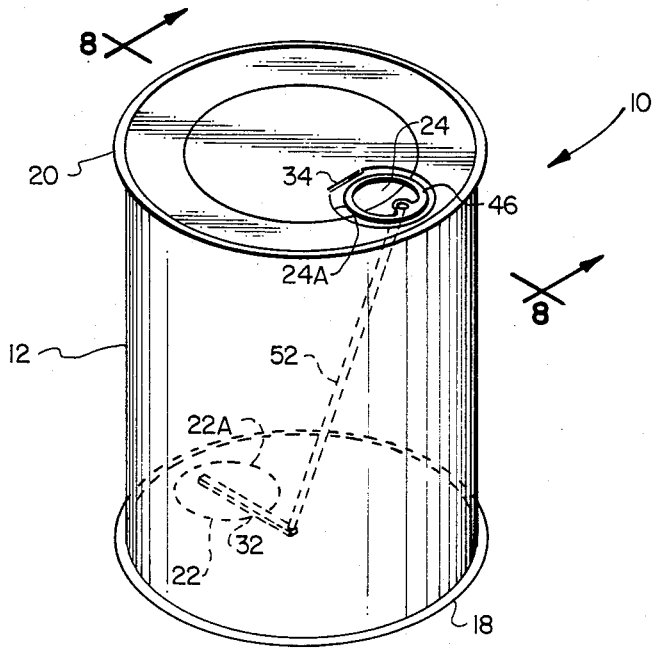
FIG. 7 is a perspective view which illustrates an alternate construction; and, FIG. 8 is a sectional view of the container assembly taken along the lines VIII—VIII of FIG. 7.
Figure 8:
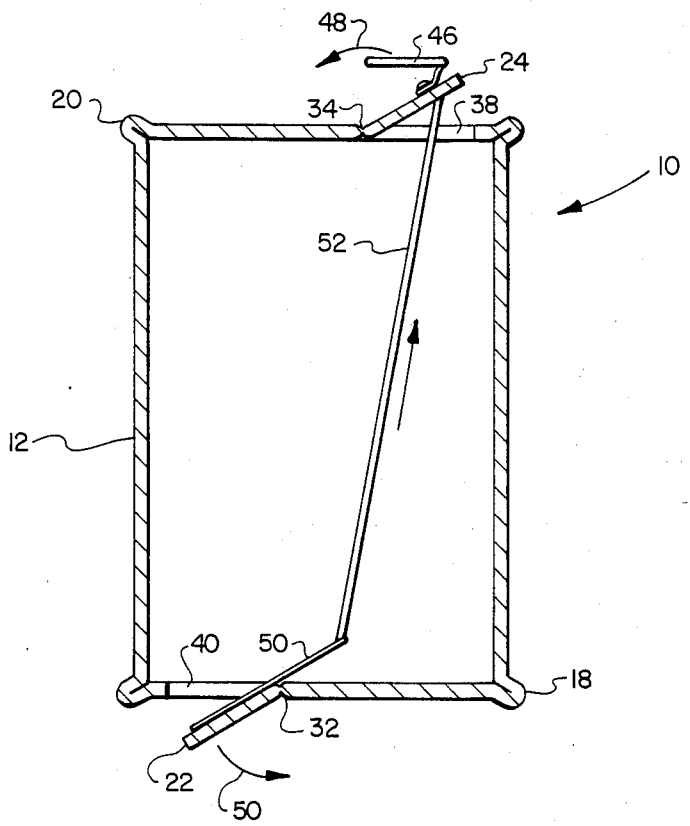

Referring now to FIGS. 7 and 8, an alternate embodiment of the invention is illustrated. The upper closure tab 24 is provided with a pull tab 46 whereby an outwardly directed force can be applied to the upper closure tab member 24. In this arrangement, the upper tab portion 24 rotates in a counterclockwise direction as indicated by the arrow 48. The lower tab member 22 rotates in the counterclockwise direction as indicated by the arrow 48. The forces applied to the pull tab 46 which cause the upper tab portion 24 to rotate are applied to the lower tab portion 22 through a pivot bar 50 and a connecting member 52. One side of the pivot bar 50 is bonded to the closure tab member 22 prior to assembly. The connecting member 52 is attached to the opposite end of the pivot bar 50 prior to assembly. During assembly, the upper end of the connecting member 52 is secured to the underside of the upper closure tab member 24. The connecting member 52 may be rigid or flexible provided, however, it has sufficient strength to sustain the tension loading applied as the upper and lower tabs are opened.

Referring now to FIG. 4, the container assembly 10 is an oil can which is full of oil and which has been placed onto an upright resting position on the oil fill opening 28 of the engine 30. While the can is in this position, finger pressure is applied against the upper tab closure 24 until the upper and lower tab closure members are completely opened, thereby allowing air to vent into the can through the upper opening 38, and allowing oil to drain into the engine crankcase through the lower drainage opening 40. According to this arrangement, the contents are completely emptied without the employment of auxillary tools or equipment such as can openers, bayonet pour spouts and funnels.

Although preferred embodiments of the invention have been described in detail, it should be understood that various changes, alterations and modifications can be made therein without departing from the spirit and scope of the invention as defined by the appended claims.

What is claimed is:

1. A disposable container assembly comprising a container body formed by a cylindrical sidewall member having opposite ends which are sealed along a rim by first and second lid members, said first and second lid members having first and second tab portions defined by curved score lines, and a rigid connecting rod disposed within the interior of said container and coupled between said first and second tab members whereby an inwardly directed force applied to one of said tab members causes the tab member to separate from said lid and rotate inwardly, and the other tab member to separate away from said lid and rotate outwardly.

2. The container assembly as defined in claim 1, wherein one end of said connecting rod is intersected by an axial bore, and a plunger rod segment is received for axial displacement within said bore and is lodged in frictional engagement with the sidewall of said bore.

3. A disposable container assembly comprising a container body formed by a cylindrical sidewall member having opposite ends which are sealed along a rim by first and second lid members, said first and second lid members having first and second tab closure members defined by curved score lines, including a pivot bar received within the interior of said container assembly and having one end portion bonded to one of said tab closure members, and including a pull tab attached to the exterior surface of the other tab closure member, and a connecting member received within the interior of said container assembly and interconnecting the opposite end of said pivot bar with the closure tab member to which the pull tab is attached.

* * * * *